US011540376B2

(12) United States Patent
Malyna et al.

(10) Patent No.: US 11,540,376 B2
(45) Date of Patent: Dec. 27, 2022

(54) POWER SOURCE TYPE DETERMINER

(71) Applicant: SIGNIFY HOLDING B.V., Eindhoven (NL)

(72) Inventors: Dmytro Viktorovych Malyna, Achel (BE); Jie Fu, Shanghai (CN); Raimundo De Heer Galisteo, Uden (NL); Zhiquan Chen, Shanghai (CN); Marcus Cornelis Van Meel, Helmond (NL); Simon Jacobus Maria Kuppens, Geldrop (NL); Yuanqiang Liu, Shanghai (CN); Shiguang Sun, Shanghai (CN); Fan Zheng, Shanghai (CN); Paul Robert Veldman, Oss (NL); Gang Wang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/422,263

(22) PCT Filed: Jan. 14, 2020

(86) PCT No.: PCT/EP2020/050775
§ 371 (c)(1),
(2) Date: Jul. 12, 2021

(87) PCT Pub. No.: WO2020/148259
PCT Pub. Date: Jul. 23, 2020

(65) Prior Publication Data

US 2022/0095433 A1 Mar. 24, 2022

(30) Foreign Application Priority Data

Jan. 16, 2019 (WO) ..... PCT/CN2019/071991
Mar. 8, 2019 (EP) ..... 19161481

(51) Int. Cl.
*H05B 45/50* (2022.01)
*H05B 45/3725* (2020.01)
*H05B 45/357* (2020.01)

(52) U.S. Cl.
CPC ..... *H05B 45/50* (2020.01); *H05B 45/357* (2020.01); *H05B 45/3725* (2020.01)

(58) Field of Classification Search
CPC ..... H05B 45/10; H05B 45/30; H05B 45/50; H05B 45/357; H05B 45/31; H05B 45/32;
(Continued)

(56) References Cited

U.S. PATENT DOCUMENTS 9,265,100 B2 * 2/2016 Nakano ..... H05B 45/40
9,655,188 B1 5/2017 Lewis et al.
(Continued)

FOREIGN PATENT DOCUMENTS

CN 107567150 A * 1/2018 ..... H05B 33/0815

*Primary Examiner* — Abdullah A Riyami
*Assistant Examiner* — Syed M Kaiser

(57) ABSTRACT

A device for determining a type of a power source for powering a LED lighting unit, wherein one possible type comprises a ballast originally designed for a high intensity discharge lamp and repurposed for use with an LED lighting unit. The power source type determiner monitors at least one electrical parameter of either a load or the power source itself after a power drawn by the load whose characteristic is set to a critical value. A value of the electrical parameter is used to identify a type of the power source. A value of the electrical parameter is the pulse generated by the traditional ballast for gas discharge lamp, which pulse is detected to determine the type of the power source.

16 Claims, 10 Drawing Sheets

(58) Field of Classification Search
CPC ..... H05B 45/34; H05B 45/35; H05B 47/105; H05B 47/14; H05B 45/325
See application file for complete search history.

(56) References Cited

U.S. PATENT DOCUMENTS

| | | | | |
|---|---|---|---|---|
| 10,267,486 | B1 * | 4/2019 | Mao | F21V 33/0052 |
| 10,314,134 | B1 * | 6/2019 | Wu | H05B 47/20 |
| 10,470,279 | B1 * | 11/2019 | Fultz | H05B 47/19 |
| 2013/0320869 | A1 | 12/2013 | Jans et al. | |
| 2014/0077722 | A1 | 3/2014 | Takacs et al. | |
| 2016/0161103 | A1 | 6/2016 | Ramaiah et al. | |
| 2016/0174326 | A1 | 6/2016 | Van Dijk et al. | |
| 2017/0122542 | A1 | 5/2017 | Shum | |
| 2018/0014395 | A1 * | 1/2018 | Ichikawa | H05B 47/16 |
| 2018/0027622 | A1 * | 1/2018 | Doi | H05B 45/10 315/307 |
| 2018/0132331 | A1 | 5/2018 | Segers et al. | |
| 2018/0224074 | A1 * | 8/2018 | Xiong | F21K 9/27 |
| 2019/0281675 | A1 * | 9/2019 | Scott | H05B 47/115 |

* cited by examiner

POWER SOURCE TYPE DETERMINER

CROSS-REFERENCE TO PRIOR APPLICATIONS

This application is the U.S. National Phase application under 35 U.S.C. § 371 of International Application No. PCT/EP2020/050775, filed on Jan. 14, 2020, which claims the benefits of European Patent Application No. 19161481.7, filed on Mar. 8, 2019, and International Application No. PCT/CN2019/071991, filed on Jan. 16, 2019. These applications are hereby incorporated by reference herein.

FIELD OF THE INVENTION

The present invention relates to the field of identifying power sources, and in particular to identifying power sources for a LED lighting unit.

BACKGROUND OF THE INVENTION

In the field of lighting, there has been a growing interest in LED lighting units for replacing or retrofitting older lighting units, and in particular high-intensity discharge (HID) lamps. These retrofit LED lighting units need to be appropriately designed so that they are able to draw power from a power source that was originally designed for powering an HID lamp.

However, at a time of installing the LED lighting unit, it is recognized that the power source (originally designed for the HID lamp) may be one a number of different types. A first type of power source, "Type A", is a power source that has been unaltered since its design for providing power to an HID lamp, and therefore comprises a ballast connected to a mains supply (e.g. from the AC mains grid), which is typically formed of an electromagnetic (EM) ballast (e.g. comprising an inductor), igniter and (optionally) a compensation capacitor. A second type of power source, "Type B", is an altered power source comprising the mains supply, but in which at least one component of the ballast, such as the igniter and EM ballast (and optionally compensation capacitor) have been removed, is absent, deactivated or bypassed. In embodiments, the "Type B" power source may comprise only the mains supply. This may be because the power source was originally designed to connect to an HID lamp with an internal igniter (and thereby did not require an igniter in an external power source). Alternatively this is the trend for new installations where people no longer need a traditional or even useless ballast for LED based lighting unit.

There may be additional sub-types with each type of power source (e.g. each type representing a different RMS voltage level, different circuit arrangement and/or impedance). Of course, each sub-type may, by itself, be considered a type of power source.

By way of example, different types of power source may contain a Mercury-Vapor (MV) ballast for Mercury-Vapor lamps or a High-Pressure Sodium (SON) ballast for High-Pressure Sodium lamps. The MV ballast contains no igniter or an igniter with high trigger voltage of around 250V. The SON ballast contains an igniter with low trigger voltage of around 160V.

If a universal LED lighting unit is to be used, regardless of the type of the power source to which the LED lighting unit is connected, there is a desire to accurately identify a type of the power source before or when installing/starting up the LED lighting unit. This allows an operating mode, point or configuration of the (driver for the) LED lighting unit to be appropriately set for the type of power source, and/or allow an appropriately designed (driver for the) LED lighting unit to be selected for connecting to the power source. This is because some operation(s) of the LED lighting unit that are appropriate for power sources with ballasts may not be appropriate for direct mains connection, or operation(s) of the LED lighting unit that are appropriate for some types of ballast may not be appropriate for other types of ballast.

US20130320869A1 discloses a TLED lamp employ a ballast type detection algorithm.

SUMMARY OF THE INVENTION

A basic idea of embodiments of the invention is to identify the type of the power source by setting a load (that can draw power from the power source) to a certain/critical condition that makes the power source react, and then analyzing a characteristic of the power source's output during the reaction. From the analysis, the type of the power source is determined. More specifically, it is the pulse generated by the traditional ballast for gas discharge lamp to be detected to determine the type of the power source.

A first implementation of the basic idea is deliberately trying to trigger the possible/hypothesized existing igniter of the ballast. If existing, the igniter would output a spike or pulse once triggered, which can be detected and used to determine that the power source is of a type having that igniter, otherwise the power source can be determined to be another type. Trying to trigger the possible existing igniter could be carried out by attempting to set an output characteristic of the power source. More specifically, for an LED load, trying to trigger the possible existing igniter is carried out by setting the forward voltage of the LED load to an appropriate/critical level that would trigger the igniter.

A second implementation of the basic idea is to change an amount of power that the load attempts to draw and to then monitor how the power source reacts. Some types of power source, such as power sources not comprising a ballast, may not react significantly to the change in power drawn, but a type of power source comprising a ballast may do. Even more, some group of ballasts may react less significantly to the change than the other group of ballasts. Thus, changing the power attempted to be drawn by a load can be used to identify a type of the power source.

The invention is defined by the claims.

According to examples in accordance with an aspect of the invention, there is provided a power source type determiner for identifying a type of a power source for powering a LED lighting unit, wherein one possible type of a power source comprises a ballast originally designed for a discharge lamp. The power source type determiner comprises a control arrangement adapted to set a forward voltage level across of the LED lighting unit to at least a first forward voltage and a second forward voltage, lower than the first forward voltage; a monitoring system adapted to monitor an electrical parameter of the load or of the power source; and a type determination unit adapted to: receive, from the monitoring system, a first value of the electrical parameter, wherein the first value is obtained during a response of the power source to the control arrangement setting the forward voltage of the LED lighting unit to the first forward voltage; and process the first value to generate a type indicating signal indicating the type of the power source; wherein the electrical parameter comprises the occurrence of a pulse in a voltage level provided by the power source.

The power source type determiner thereby determines a type of the power source based on the response or reaction of an electrical characteristic of the power source (as detected at the power source or at the load) to a certain (level of a) characteristic of a load. It has been recognized that monitoring how electrical characteristics of the load or power source change or respond to a certain (level of a) characteristic of a load enables a type of the power source to be determined.

In other words, a type of power source for an LED lighting unit can be identified based on how the power source reacts to a certain load condition. The set characteristic of the load may, for example, be a power level drawn by a load, a (forward) voltage level across a load (thereby also across the power source), an impedance of a load and so on. In particular, the set characteristic of the load may be a load characteristic that changes a power level demanded or required by the load to power the load, e.g. a forward voltage level, a power drawn by the load, a resistance/impedance of the load and so on. This may therefore control characteristics, e.g. voltage level, of a power demanded by the load.

The proposed power source type determiner provides a simple and effective way to determine a type of the power source for the LED lighting unit, and thereby enables appropriate selection of an LED lighting unit (or operating mode/point/configuration of the LED lighting unit to be set). This would improve the efficiency of the overall LED lighting system.

In some embodiments, the control arrangement comprises a switch for switching a forward voltage of the load between the first forward voltage and the second forward voltage lower than the first forward voltage.

In other words, a forward voltage across an LED lighting unit may be set to a certain condition (the first level), and the response of an electrical characteristic of the power source to the condition of the forward voltage may be monitored and processed to thereby identify a type of the power source. It has been recognized that different types of power source will react differently when attempting to supply different voltage levels to a load, i.e. when the load has different forward voltages. Thus, a type of the power source can be identified based on a response of the power source when attempting to provide a certain voltage level to a load.

The pulse has a length less than a predetermined length and a magnitude of more than a predetermined magnitude. Thus, the monitoring system may be adapted to monitor for pulses in a voltage level provided by the power source (as detected at the power source or at the load).

The pulse may therefore be a voltage "spike" in the power source. The presence of a spike in electrical characteristics is considered indicative that the power source for the LED lighting unit comprises an igniter. Thus, the presence or absence of a spike in electrical characteristics indicates whether the power source is a type that comprises an igniter or a type that does not comprise an igniter.

Thus, processing the first value may comprise determining whether there is the presence or absence of one or more pulses in the power source, to thereby identify a type of the power source. The predetermined length may be no more than 100 μs (e.g. 100 μs, 50 μs or 25 μs). In some examples, the pulse has a minimum length (e.g. no less than 5 μs). The predetermined value may be no less than an eighth of the peak-to-peak voltage of the power source, e.g. no less than a quarter of the peak-to-peak voltage, e.g. no less than the peak-to-peak voltage.

In some embodiments, the electrical parameter may be a number of pulses detected or an average detection rate of pulses. This may be performed by summing or averaging (over time) a number of pulses detected.

The power source type determiner may be adapted wherein: a first type of power source comprises an igniter, and a second type of power source does not comprise an igniter; the electrical parameter comprises the occurrence of a pulse from the igniter of the power source; and the type determination unit is adapted to distinguish between the first type of power source and the second type of power source based on whether or not the first value indicates the occurrence of the pulse.

As previously explained, the presence or absence of a pulse may indicate the presence or absence of an igniter in the power source. Thus, the type determination unit may identify or distinguish a first type of power source (comprising an igniter) and a second type of power source (not comprising an igniter) based on whether or not a pulse is present or identified.

In embodiments, the first forward voltage is no less than a first threshold voltage value that would trigger an igniter of a power source to output said pulse. Thus, the first forward voltage may be set at a predicted voltage level that would be expected to trigger the igniter present in a power source of a first type. In this way, the first forward voltage may test whether the power source is or is not a power source of the first type. Preferably, the first type is a power source having a ballast for a discharge lamp, and the second type is AC mains.

In some embodiments, the power source type determiner is adapted to distinguish between at least a first type of power source and a second type of power wherein: a first type of power source comprises a SON-type ballast with a first igniter and a second type of power source comprises an MV-type ballast with a second, different igniter or without an igniter; the electrical parameter comprises the occurrence of a pulse from an igniter of a SON type ballast; and the type determination unit is adapted to generate the type indicating signal indicating the type of the power source based on whether or not the occurrence of the pulse is detected.

In embodiments, the first forward voltage is no less than a second threshold voltage value that would trigger the first igniter of the SON-type ballast to output said pulse but is preferably lower than a third threshold voltage value that would trigger the second igniter of the MV ballast. Thus, the first forward voltage may be in the region of from 160V to 250V, e.g. from 180V to 230V.

Thus, the first forward voltage may be set at a predicted voltage level that would be expected to trigger the igniter present in a power source of type comprising an SON-type ballast, but not trigger an igniter present in a power source of a type comprising an MV-type ballast. In this way, the first forward voltage may test whether the power source comprises an SON-type ballast or not without unintentionally triggering an MV-type ballast.

Preferably, the monitoring system comprises a positive pulse detector comprising: a positive voltage detector adapted to generate an output indicating whether a positive voltage is detected in a voltage level provided by the power source; a negative voltage holder adapted to: generate an output indicating whether a negative voltage is detected in a voltage level provided by the power source; hold the output for at least a holding time period after the negative voltage is removed, and a positive pulse output unit that generates an output indicating whether the output of the positive pulse detector indicates that a positive voltage is detected and the held output of the negative voltage holder indicates that a negative voltage has been detected during the holding time period preceding detection of the positive voltage by the negative voltage detector.

The monitoring system may comprise a negative pulse detector comprising: a negative voltage detector adapted to generate an output indicating whether a negative voltage is detected in a voltage level provided by the power source; a positive voltage holder adapted to: generate an output indicating whether a positive voltage is detected in a voltage level provided by the power source; hold the output for a period of time after the positive voltage is removed, and a negative pulse output unit that generates an output indicating whether the output of the negative pulse detector indicates that a negative voltage is detected and the held output of the positive voltage holder indicates that a positive voltage has been detected during the certain time period preceding detection of the negative voltage by the negative voltage detector.

In embodiments, the control arrangement comprises a switch for connecting or disconnecting the load from the power source. In this way, the control arrangement can control a power drawn by the load (e.g. between no power and at least some power). Thus, the characteristic of the load may be a power drawn (or attempted to be drawn) by the load.

Thus, the load may initially draw no power from the power source and then be switched so as to draw power from the power source (i.e. be turned on). The monitoring system can thereby monitor an electrical parameter of the load or power source during a start-up process of the load. The start-up process has been identified as being a period during which it is particularly accurate and effective to monitor electrical characteristics representative or responsive to a type of the power source.

In an embodiment, the type determination unit is further adapted to receive, from the monitoring system, a second value of the electrical parameter at a different drawn power than that at the first value, and the type determination unit is adapted to process the first value of the electrical value by: determining a change in at least one electrical parameter using the first value and the second value; and processing the change to generate a type indicating signal indicating the type of the power source for powering the LED lighting unit.

By taking two measurements at different power levels, the determining the type of power source is independent of the actual mains voltage. It has been recognized that using a single electrical measurement (e.g. voltage level) may not be a sufficiently robust indicator of a type of the power source, as such electrical measurements may be the same for different types of power source. However, a change (or delta) in an electrical parameter (e.g. voltage, current, frequency and/or phase) can more accurately distinguish between different types of power source.

Preferably, the second value of the electrical parameter is obtained when the control arrangement has set the characteristic of the load to the second level.

In other words, a respective value of an electrical parameter is obtained before and after a characteristic of the load is changed. Thus, the response of an electrical characteristic to a change in a characteristic of the load (such as the power drawn by a load) is detected. In particular, the response of an electrical characteristic a start-up process is detected. This allows for improved and more accurate determination of the type of a power source, as different types of power source have different start-up processes or responses to a change in characteristics of the load, such as a change in the power drawn by a load or a change in the effective impedance of a load.

Preferably, the second value is obtained when the load draws no (or only negligible) power and the first value is obtained after the load begins to draw (substantial or non-negligible) power. Thus, the control arrangement may be adapted to control whether or not the load draws power. Thus, in some embodiments, the second level is zero so that the load does not attempt to draw power, and the first level is larger than zero so that the load attempts to draw at least some power.

In particular embodiments, the level of the characteristic of the load is the power level drawn by the load; and the type determination unit is adapted to: receive, from the monitoring system, a second value of the electrical parameter, when the control arrangement sets the power drawn by the load to the second level; receive, from the monitoring system, the first value of the electrical parameter, when the control arrangement sets the power level drawn by the load to the first level; process the first value of the electrical value by: determining a change in the electrical parameter using the first value and the second value; and processing the change to generate a type indicating signal indicating the type of the power source for powering the LED lighting unit.

The electrical parameter (monitored by monitoring system) may comprise a magnitude characteristic or a time characteristic of a voltage level provided by the power source. In some embodiments, the electrical parameter is a magnitude characteristic such as a root mean square value, peak to peak value, or average value of the voltage level. In other examples, the electrical parameter is a time characteristic such as a frequency or a phase of the voltage level.

Preferably, there is provided an LED lighting unit comprising: an LED arrangement formed of one or more LEDs; and any power source previously described, wherein the load of the power source type determiner comprises the LED arrangement.

Thus, the power source type determiner may be integrated into an LED lighting unit, in which the load used comprises the one or more LEDs of the LED lighting unit. This can provide an LED lighting unit that can automatically detect the type of the power source and, optionally, self-adjust an operating mode/point/characteristic in order to take account of the type of the power source. This provides a LED lighting unit that is more simple to install, and requires a reduced effort by an installer.

The LED lighting unit may be further adapted to modify a configuration of the one or more LEDs based on the type indicating signal. In particular embodiments, the LED lighting unit may control a forward voltage of the one or more LEDs based on the type indicating signal.

The LED arrangement may comprise a first LED array and a second LED array. The LED lighting unit may be adapted to control whether the first and second LED arrays are in series or in parallel to thereby control a forward voltage of the one or more LEDs for setting the critical condition. In other embodiments, at least one of the LED arrays may be bypassed in order to control a forward voltage of the one or more LEDs.

After the type of power source is determined, the LED arrays can then be set in series or in parallel according to the type of the power source, for achieving regulated power, efficiency, power factor, etc. The applicant has filed or will file separate applications for this concept thus its details are only briefly described in this application.

A LED lighting unit further comprising:

a first converter adapted to connect to the power source and convert the power from the power source to a first power;

a second converter to convert the first power to a second power to the LED arrangement;

the first converter is adapted to be in a full pass-through operation and the second converter is adapted to set the forward voltage as the first forward voltage to facilitate the determination of the power source determiner;

wherein, the first converter is adapted to be in a partially pass-through operation when the power source has been determined as the ballast originally designed for a discharge lamp in the determination;

characterized in that, the first converter is adapted to decrease the first power and the forward voltage across the LED lighting unit to the second forward voltage to stop the ballast from generating the pulse, wherein the first converter is adapted to decrease the first power at a speed to which the second converter is responsive.

This embodiment provides a subsequent operation after the determination, in order to stop the igniter's operation to avoid damage of the igniter. This embodiment also maintains constant light output in the subsequent operation.

More specifically, the first converter is a shunt switch circuit to short circuit the LED lighting unit, and the second converter is a switch mode converter with PFC function and a PFC response speed, the first converter is adapted to be in a full pass-through operation by not short circuit the LED lighting unit at all, and the second converters is adapted to implement PFC function, when the power source has been determined as AC mains.

This embodiment defines how the double converter topology operates in case that the power source is AC mains.

According to examples in accordance with an aspect of the invention, there is provided a method of determining a type of a power source, for an LED lighting unit, wherein one possible type of a power source comprises a ballast originally designed for a discharge lamp. The method comprises: setting a characteristic of a load to a first level able to draw power from the power source; after setting the characteristic to the first level, obtaining a first value of an electrical parameter of the load or the power source; and processing the first value to generate a type indicating signal indicating the type of the power source, In some embodiments, the step of setting comprises setting a forward voltage of the load as the first level to no less than a first threshold value for attempting to trigger a igniter of the power source to output a pulse; the step of obtaining a first value of an electrical parameter comprises obtaining a value indicating whether a pulse has occurred; and the step of processing the first value comprises generating the type indicating signal indicating whether or not a pulse has occurred and thereby whether or not the power source is of a type comprising the igniter.

In other embodiments, the step of setting comprises switching a power level of a power drawn by a load from a second level to the first, higher level; the step of obtaining a first value comprises obtaining a second value before the switch and obtaining the first value after the switch; and the step of processing the first value comprises processing the difference between first and second values to thereby generate a type indicating signal indicating the type of the power source.

According to examples in accordance with an aspect of the invention, there is provided a method of determining a type of a power source for an LED lighting unit and originally designed for a high intensity discharge lamp. The method comprises: modifying a level of power provided by the power source to a load for drawing power from the power source; after modifying the level of power, obtaining a first value of an electrical parameter of the load or the power source; and processing the first value to generate a type indicating signal indicating the type of the power source for powering the LED lighting unit.

In embodiments, the electrical parameter comprises the occurrence of a pulse in a voltage level provided by the power source, wherein the pulse has a length less than a predetermined length and a magnitude of more than a predetermined magnitude.

The method may further comprise, before obtaining the first value of an electrical parameter, obtaining a second value of the electrical parameter. In this embodiment, the step of processing the first value comprises: determining a change in the at least one electrical parameter using the first value and the second value; and processing the change to generate a type indicating signal indicating the type of the power source for powering the LED lighting unit.

The step of obtaining the second value of electrical parameter is preferably performed before the step of modifying the level of power provided by the power source to the load.

According to examples in accordance with an aspect of the invention, there is also provided a computer program comprising code means for implementing any described method when said program is run on a computer.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which:

FIG. 17 shows a flowchart of determining the type of the power source by comparing the power source's output voltage waveform before and after a parallel output capacitor is switched in.

DETAILED DESCRIPTION OF THE EMBODIMENTS

Figure 1:
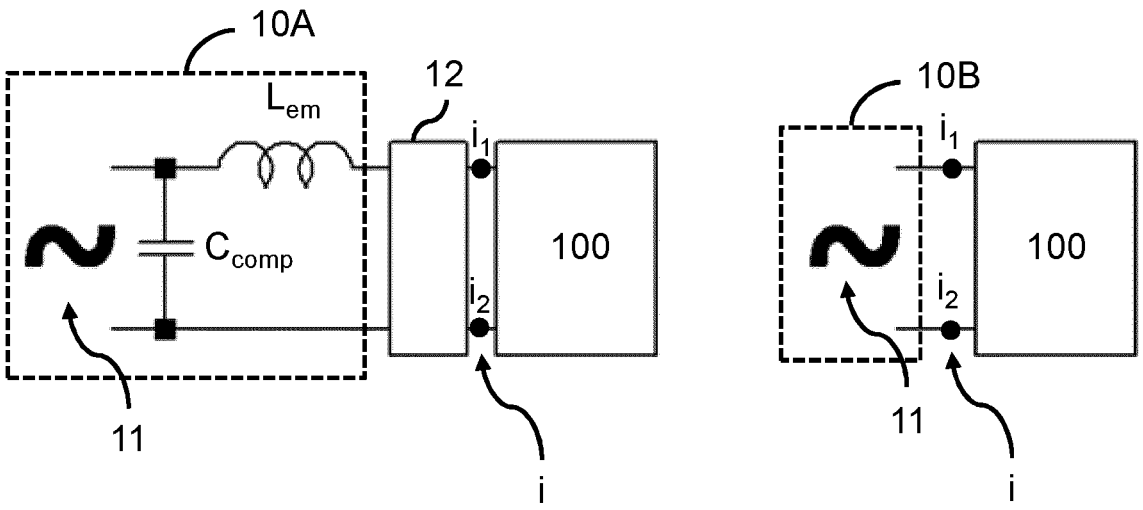
FIG. 1 illustrates two types of power source originally designed for a high intensity discharge lamp.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a device for determining a type of a power source, of which one possible type includes a ballast originally designed for a high intensity discharge lamp and repurposed for use with an LED lighting unit. The power source type determiner monitors at least one electrical parameter of either a load or the power source itself after a characteristic of the load is set to a first level or value. A value of the electrical parameter is then used to identify a type of the power source.

One aspect of the invention is based on the realization that a response of a power source to a certain characteristic of a load, such as when power begins to be drawn by a load or a particular voltage level is demanded by a load, is indicative of the type of the power source. In particular, a start-up process or response of a power source to a particular characteristic of a load, such as drawn power level, causes different electrical parameters depending upon the type of the power source.

After the type of the power source has been determined, embodiments may be employed in a lighting system to modify the operating point, mode or configuration of an LED lighting unit to be connected to the power source. This can therefore enable more efficient LED lighting units to be provided.

FIG. 1 illustrates two types of power source for powering an LED lighting unit 100. The LED lighting unit 100 connects to an input interface i formed of one or more input nodes $i_1$, $i_2$ to draw power from the power source.

A first type of power source 10A is an unmodified power source for a high-intensity discharge (HID) lamp. The power source 10A is powered by a mains supply 11, and comprises a (optional) compensator capacitor $C_{comp}$, an electromagnetic (EM) ballast $L_{em}$, and an (optional) igniter 12. When operating, the igniter 12 creates high frequency and high voltage oscillations designed to ignite an HID lamp (mostly for ionizing the gas in the (gas) discharge lamp, after which the ballast's normal output current lights the lamp and the igniter stops operating. The EM ballast $L_{em}$ is designed to regulate a current through the HID lamp whilst the HID lamp outputs light. A compensator capacitor $C_{comp}$ is an AC capacitor designed for individual correction of the power factor of the EM ballast $L_{em}$.

Thus a first type of power source may be called a "ballast input".

A second type of power source 10B is a modified power source, optionally for the HID lamp with built in ballast circuit, in which the compensator capacitor $C_{comp}$, electromagnetic ballast $L_{em}$ and igniter 12 have been removed (or were never initially present). The second type of power source 10B therefore effectively comprises only a mains supply 11. Thus, the second type of power source may be called a "mains input". The second type is also popular for new installations: there is no need to add a ballast for discharge lamp where LED lighting units will be equipped.

Given the different installation scenarios, it is beneficial for the manufacturer as well as the customer to have one universal LED lighting unit that can be used in any scenario. The customer does not need to check his installation and by the right model of lamp; and the manufacturer does not need to stock different models of lamps. For this purpose, the first step is for a lamp to know what the type of the power source is. Thus it is an aim of the invention to distinguish between different types of power source such as power sources comprising ballasts originally designed for an HID lamp and power sources formed of only a mains supply, such as the first and second types described above. Proposed embodiments monitor electrical parameter of the power source and/or a connected load (e.g. LED lighting unit) to identify a type of the power source. This enables an operating mode/point/configuration of a LED lighting unit, to be connected to the power source, to be appropriately modified afterwards.

The present invention will generally be explained in the context of the first and second above-described types for a power source (e.g. where a ballast and igniter either do, for a first type, or do not, for the second type, contribute to the power drawn by a connected load). However, the invention may be extended to other types of power source (e.g. comprising ballast(s) and/or igniter(s) of different types, configurations or component values).

Figure 2:
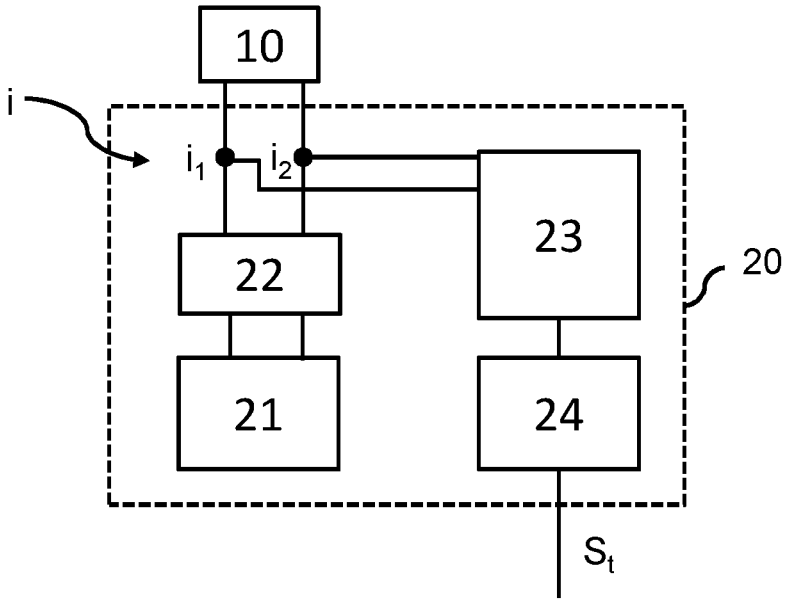
FIG. 2 illustrates a power source type determiner according to an embodiment of the invention.

FIG. 2 illustrates a power source type determiner 20 according to a general embodiment of the invention.

The power source type determiner 20 comprises a load 21 for drawing power from the power source. The load may comprise any suitable component for drawing power, such as a resistor or other impedance arrangement. In preferable embodiments, as later described, the load may comprise an LED arrangement of an LED lighting unit.

The power source type determiner 20 also comprises a control arrangement 22 adapted to control, change or otherwise set a level of a characteristic of the load. In particular, the control arrangement 22 controls, changes or sets a level of a characteristic of the load between at least a first and second, lower level.

In one example, the control arrangement may control a level of the power drawn by the load. By way of example, the control arrangement may comprise a switch for connecting or disconnecting the load from the power source (to switch from a second power level, i.e. no power, to a first power level, i.e. at least some power). In another example, the control arrangement may control a forward voltage across the load 21 and/or an effective resistance (e.g. between a first resistance and a second, lower resistance) of the load.

The control arrangement may be responsive to a manual toggle or user input (e.g. a light switch) or to a signal from a control unit (not shown), which is designed to automatically test the type of the power source in power up.

The power source type determiner also comprises a monitoring system 23 adapted to monitor an electrical parameter of the load or of the power source. For example, as illustrated, the monitoring system may monitor a voltage level provided or drawn by the load 21. Other examples will be set out below.

The power source type determiner further comprises a type determination unit 24 adapted to receive, from the monitoring system 23, a first value of the electrical parameter, wherein the first value is obtained when the control arrangement has set a level of the characteristic of the load to a first level; and process the first value to generate a type indicating signal $S_t$ indicating the type of the power source for powering the LED lighting unit.

In particular embodiments, the first value of the electrical parameter is obtained during a start-up process of the power source (i.e. during a period immediately after a level of power provided to the load has been first set or changed by the control arrangement).

The type indicating signal may, for example, be a binary signal indicating whether the power source is the first type or the second type. This binary signal can be used to control or define an operation (e.g. operating mode, point or configuration) of an LED lighting unit connected to draw power from the power source.

Thus, the power source type determiner 20 effectively determines a type of the power source. In particular, the power source type determiner may be able to distinguish between a power source of a first type 10A (comprising at least an igniter and a ballast that contribute to the power to be provided to a connected LED lighting unit) and a power source of a second type 10B (in which the igniter and ballast are absent or otherwise do not contribute to the power to be provided to a connected LED lighting unit).

In particular embodiments, the monitoring system 23 may be adapted to monitor an electrical characteristic that differs depending on whether a power source comprises an igniter/ballast or not. Examples of such electrical characteristics include a change in magnitude of a voltage level provided by the power source (e.g. as an input power supply) in response to a change in the power drawn by a load, a change in phase of the input power supply (in response to a change in the amount of power drawn by a load), or pulses/spikes in the power supply provided by a power source (indicative of the presence of an igniter in the power source).

In a first example, the control arrangement 22 is adapted to controllably switch a power drawn from the load between a second power level (e.g. no power, where the load does not draw power) and a first, different power level (e.g. full power where the load draws power). In particular examples, the control arrangement 22 may controllably connect and disconnect the load from the input arrangement, e.g. using one or more switches.

The monitoring system 23 may measure a root mean square (RMS) voltage between the nodes $i_1$, $i_2$ of the input arrangement whilst the load draws a first power level and whilst the load draws a second power level, to obtain a first value and second value respectively. Thus, two measurements of the RMS voltage may be generated. A first value of the RMS voltage represents an RMS voltage whilst the load draws a first power level and a second value of the RMS voltage represents an RMS voltage whilst the load draws a second power level. The second value effectively represents a reference measurement.

The difference between the first and second values is indicative of the type of the power source. In particular, where the power source is of the second type (e.g. not comprising a ballast or igniter) the first value of the RMS voltage will be substantially identical (e.g. ±5%) to the second value of the RMS voltage. Where the power source is of the first above-type (e.g. comprising a ballast and igniter), the first value of the RMS voltage will be less than (e.g. by more than a predetermined amount, such as 5% or 10%) the second value of the RMS voltage. This is because there will be a voltage drop across at least the EM ballast.

Thus, by monitoring a change in the RMS voltage provided at an input interface i for the LED lighting unit, when there is a change in the amount of power drawn by a load 21 connected thereto, a distinction can be made between different types of power source. In particular, a distinction can be made as to whether a power source comprises a ballast that contributes to the power that is drawn by a connected device.

Where the second power level is no power (i.e. zero), the second value obtained at the second power level will be substantially similar or identical between different types of power source as the first value at the first power level, with respect to the mains supply voltage, as no/negligible current flows in the EM ballast (caused by the drawing of power by a connected load). Where the second power level is no power, and the first power level is an amount of power (e.g. full power), the first value, obtained at the first power level, will change based on the type of the power source from the second value at the second power level, as an EM ballast will cause a voltage drop as the load draws more power.

The type indicating signal $S_t$ can thereby be controlled based on the change in the RMS voltage provided at an input interface for the LED lighting unit.

A further distinction can be made if the first value is less than (by more than predetermined amount) the second value. In particular, the magnitude of the change in RMS voltage can inform whether the change is in the range fitting a first group of one or more EM ballasts, a second group of one or more EM ballasts or neither of the two. In this way, a sub-type of a power source can also be determined, where each sub-type represents a different power source (of the first type) with different ballasts.

In a second example, a shift in phase of a monitored voltage level (e.g. within the load 21 or at the input interface i) is monitored by the monitoring system 23 and used to identify the type of power source. In such an embodiment, a time reference is established whilst the load draws a second power level (e.g. no power), e.g. via a phase locked loop. The load is then configured to draw a first, different power level (e.g. draws full power), and a shift in phase is determined.

Where the power source is of the second type (e.g. a mains supply not comprising a ballast or igniter) the shift in phase will be negligible (e.g. ±1%). Where the power source is of the first type (e.g. comprising a ballast and igniter), the shift in phase will be noticeable (e.g. more than a predetermined amount, such as more than 5% or 10%). This is because the voltage drop across the EM ballast will cause a noticeable shift in the phase in the sensed signal as the power level changes.

Again, in case the power source is of a first type, the magnitude of the shift in phase can even tell us if the change is in the range fitting a first group of one or more EM ballasts, a second group of one or more EM ballasts or neither of the two.

Thus, the first and second examples provide a simple method of detecting whether a power source comprises a ballast that contributes to power drawn by a connected load (i.e. is a "first type") or does not comprise such a ballast (i.e. is a "second type"). The type indicating signal $S_t$ may carry information (e.g. a binary signal) indicating the type of the power source.

A further distinction of the type of ballast, and thereby type of power source, can also be made, which distinction may also be carried by the type indicating signal. This may be performed by assessing a magnitude of a difference between the second and first values (different ballast being associated with different ranges of magnitudes).

The first and second examples thereby share a same idea of making a step in or changing a resistance of the load (and thereby power drawn) that the power source type determiner forms at its input interface i, and establishing the delta/change in a particular electrical parameter (e.g. voltage, current, frequency and/or phase) of the load or power source. Based on said delta/change in the sensed signal(s), a type of the power source can be determined.

In a third example of the invention, the monitoring system may be adapted to detect the occurrence of a pulse or spike in a certain voltage level provided by the power source, wherein the pulse has a length less than a predetermined length and a magnitude of more than a predetermined magnitude. Thus, the monitored parameter may be the occurrence of a pulse. The pulse, if any, would come from an igniter of a ballast. A direct mains connection would not generate pulse or spike. By monitoring whether the occurrence of the pulse or spike, the type of the power source can be determined.

More specifically, an igniter of a ballast causes pulses or spikes if the power source outputs/faces a certain output voltage level provided, for example, during a start-up process, but would not cause pulse/spikes if the output voltage is below that level. This is the inherent function of the igniter to start a discharge lamp, as the resistance of a discharge lamp is high before it turns on and the igniter therefore uses the pulses to turn it on/ionize the gas within the lamp. The presence or absence of a pulse during this start-up process is therefore indicative of whether or not an igniter contributes to the power provided by a power source, and thereby whether a power source is of a first type or second type (described above).

Thus, by setting a forward voltage or resistance of a load at a first level high enough to trigger the igniter, a start-up process of the power source can be initiated by the control arrangement, and the presence or absence of a pulse or pulses can be detected to determine whether or not the power source comprises an igniter (e.g. is of a first type or a second type).

Different forward voltages or resistances may be used to test for different igniters, and therefore different types of power source. Different igniters may begin pulsing when a power source attempts to provide different voltage levels to a load. For example, the MV ballast contains no igniter or an igniter with high trigger voltage of around 250V. The SON ballast contains an igniter with low trigger voltage of around 160V. Thus, by changing the forward voltage or resistance of a load between different levels/values, and monitoring for pulses from the power source, it is possible to test whether different igniters are present, and thereby test for a type of the power source.

Figure 3:
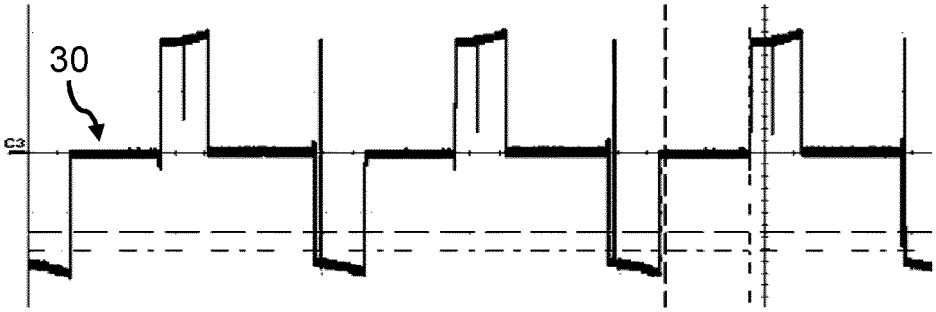
FIG. 3 illustrates an output of a power source of a first type, after a load begins drawing power from the power source.

FIG. 3 illustrates a voltage level 30 provided by a power source during a start-up process, where the power source is originally designed for an HID lamp and comprises an igniter that generates to the spike. As illustrated, the start-up process causes spikes or pulses to appear the voltage level. The spike is shown by reference signs 32.

Figure 4:
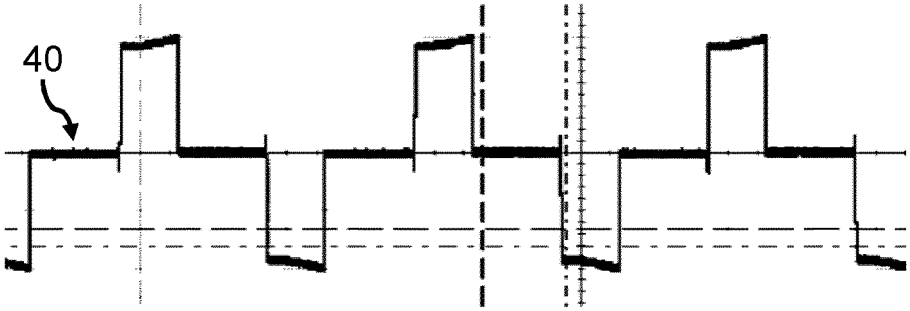
FIG. 4 illustrates an output of a power source of a second type, after a load begins drawing power from the power source.

FIG. 4 illustrates a voltage level 40 provided by a power source during a start-up process, where the power source is originally designed for an HID lamp and the igniter has been removed, bypassed or deactivated so that it does not generate the spike/pulse. Thus, as illustrated, the start-up process does not comprise spikes or pulses.

Thus, it is possible to distinguish between at least a first and second type of a power source using the presence or absence of spikes during an initiated start-up process, i.e. when a forward voltage or resistance of a load is (first) set to a first level.

It is also notable, for the purposes of later explanation, that the voltage level provided by each power source alternates between a positive polarity and a negative polarity, where there is a period of time between each polarity (during which time the voltage level is substantially 0). This is the conventional waveform for a power supply provided by a power source designed for a high-intensity discharge lamp.

Figure 5:
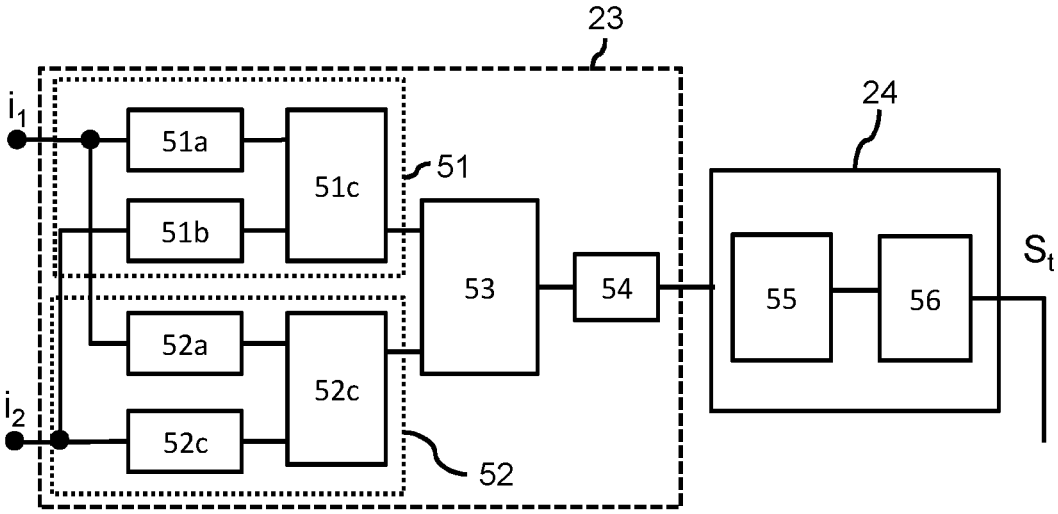
FIG. 5 is a block diagram illustrating a monitoring system and a type determination unit according to an embodiment.

FIG. 5 illustrates a block diagram of a monitoring system 23 and a type determination unit 24 according to an embodiment of the invention. The monitoring system 23 is adapted to detect pulses in the voltage level provided by the power source and the type determination unit 24 is adapted to generate a type indicating signal indicating the type of the power source. For example, the type determination unit may provide a signal providing a positive or negative determination of whether the power source is a first or second type.

The monitoring system 23 comprises a positive pulse detector 51 and a negative pulse detector 52.

The positive pulse detector 51 is adapted to generate an indicator when a positive pulse is detected whilst the polarity of the voltage level provided by power supply (i.e. immediately preceding and/or following the pulse) is negative. The negative pulse detector 52 is adapted to generate an indicator when a negative pulse is detected whilst the polarity of the voltage level provided by power supply (i.e. immediately preceding and/or following the pulse) is positive.

In the illustrated example, the positive pulse detector 51 comprises a positive voltage detector 51A that generates an output indicating whether a positive voltage is detected. The positive pulse detector also comprises a negative voltage holder 51B, which generates an output indicating whether a negative voltage is detected and holds the output for a holding time period after the negative voltage is removed (e.g. using a capacitor). The positive pulse detector also comprises a positive pulse output unit 51C that generates an output indicating whether the positive pulse detector indicates that a positive voltage is detected and the negative voltage holder is holding an output that indicates that a negative voltage has been previously detected (i.e. in the certain time period before the positive voltage was detected). In this way, the positive pulse detector generates an output indicating whether a positive pulse is detected during a negative cycle of the power supply.

The holding period may be less than the period of time between a positive polarity of the voltage level and a negative polarity of the voltage level (previously explained with reference to FIGS. 3 and 4). In this way, the positive pulse detector is specifically designed for use with power sources designed for HID lamps, as other power sources may flip polarity without having a period of time between the positive and negative polarities of the output supply.

Similarly, the illustrated negative pulse detector 52 comprises a negative voltage detector 52A that generates an output indicating whether a negative voltage is detected. The positive pulse detector 52 also comprises a positive voltage holder 52B, which generates an output indicating whether a positive voltage is detected and holds the output for a certain period of time after the positive voltage is removed (e.g. using a capacitor). The negative pulse detector also comprises a negative pulse output unit 52C that generates an output indicating whether the output of the negative pulse detector indicates that a negative voltage is detected and the held output of the positive voltage holder indicates that a positive voltage has been previously detected (i.e. in the certain time period before the negative voltage was detected). Thus, the negative pulse detector generates an output indicating whether a negative pulse is detected.

In this way, a negative pulse can also be detected.

Presence of both a positive and negative pulse detector is particularly beneficial, as some igniters trigger at only a single polarity.

The monitoring system further comprises an OR element 53 adapted to generate an output indicating whether either the output of the positive pulse detector indicates that a positive pulse is detected or the output of the negative pulse detector indicates that a negative pulse is detected. Thus, the OR element 53 generates an output indicating whether or not a pulse (positive or negative) has been detected.

The monitoring system may further comprise a low pass filter 54 for filtering the output of the OR element 53. The low pass filter 54 filters false dips. The low pass filter 54 may also act to transform detection of pulses into an average detection rate, by smoothing the output from the OR element.

The type determination unit 24 is adapted to receive the output of the OR element 53 (or the low pass filter 54). The output of the OR element indicates whether a pulse has been detected. Based on the output of the OR element (i.e. occurrence or non-occurrence of a pulse), the type determination unit 24 determines a type of the power source and generates a type indicating signal indicating the type of the power source. This may be done by, for example, identifying whether at least a predetermined number of pulses has been detected or by identifying whether an average detection rate is above a predetermined level.

By way of example, the type determination unit 24 may comprise a comparator 55 adapted to compare the output of the OR element 53 (or low pass filter 54) to a predetermined value. The comparator may determine whether an average detection rate is above a predetermined level (e.g. by compare a determined average detection rate to a predetermined value) or whether the number of pulses detected is above a predetermined threshold (by counting a number of pulses and comparing the counted number to a predetermined value). This comparison may be performed in the analog or digital domain.

In embodiments, the default output of the type determination unit (i.e. the type indicating signal) may indicate that the power source is of the second type. The output may be switched (e.g. to indicate that the power source is of the first type) in response to a predetermined number of pulses being detected or an average detection rate being above a predetermined level. Thus, presence of pulses may switch the type indicating signal to indicate that an igniter contributes to the power provided by the power source, i.e. the power source is of the first type. Otherwise, the type indicating signal may indicate that an igniter does not contribute to the power provided by the power source, i.e. the power source is of the second type.

The type determination unit may further comprise a latch 56 that latches the output $S_t$ of the type determination unit if it switches (e.g. to indicate that the power source is of the first type). The latch may be reset in response to the power supply being reset or in response to the load no longer drawing the second power level.

Figure 6:
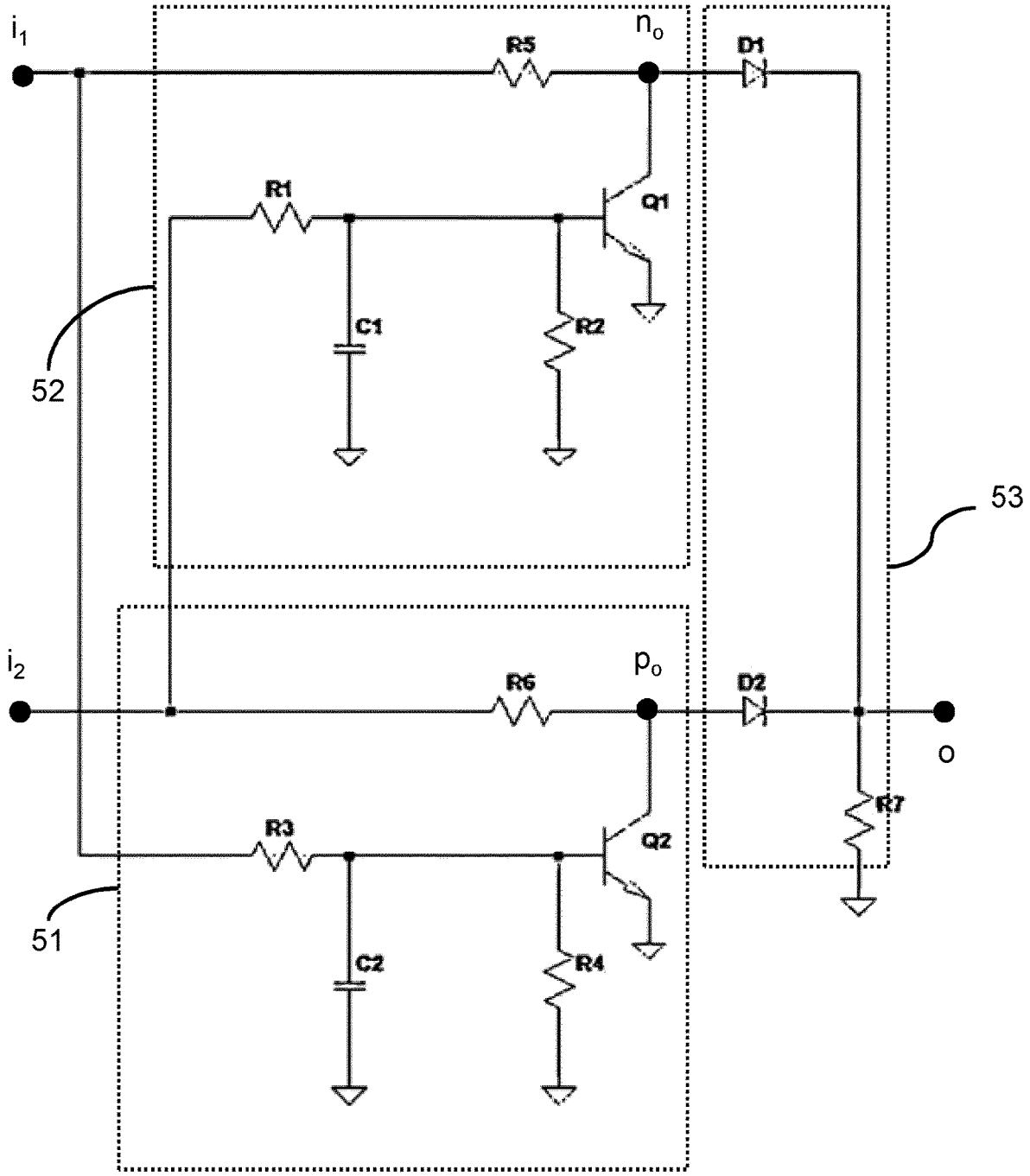
FIG. 6 is a circuit diagram illustrating part of a monitoring system according to an embodiment.

FIG. 6 is a circuit diagram illustrating part of a monitoring system 23 according to an embodiment. The monitoring system comprises a positive pulse determiner 51, a negative pulse determiner 52 and an OR element 53. The OR element effectively performs an OR operation on the output at node $n_o$ of the negative determiner and the output at node $p_o$ of the positive determiner to provide a result of the OR operation at an output node o.

The input nodes $i_1$ and $i_2$ are connected to a positive and negative of the power source respectively. Thus, there is a positive node $i_1$ and a negative node $i_2$.

A process of detecting a positive pulse (when the input voltage is negative) is hereafter described. For the sake of clarity, a voltage level is described as "high" or "low", which represents whether a voltage at a particular node is greater than a ground voltage ("high") or at or below a ground voltage ("low").

When the input is at a negative steady state, a positive node $i_1$ is low and a negative node $i_2$ is high. The positive pulse output $p_o$ is also held high (via the resistor $R_6$, as the switch $Q_2$ will be off). Thus, the output node o is held high (via diode $D_2$) Moreover, the capacitor $C_1$ is charged via resistor $R_1$, which closes the switch $Q_1$ (here a BJT). Thus, the negative pulse output $n_o$ is held low (but current cannot flow from the positive pulse output node $p_o$ to ground through switch $Q_1$ due to the diode $D_1$).

When a sudden positive pulse occurs (in the negative steady state), the positive node $i_1$ switches high and the negative node $i_2$ switches low. The positive pulse output $p_o$ therefore switches low. The negative pulse output $n_o$ is also held low, as the stored charge of the capacitor $C_1$ keeps the switch $Q_1$ open. Thus, the output node o is pulled low (as there is no high voltage provided thereto).

Thus, a low output at the output node o indicates whether a pulse has occurred. A similar operation takes place to detect a negative pulse (during a positive steady state).

When the input is at a positive steady state, a positive node $i_1$ is high and a negative node $i_2$ is low. The negative pulse output $n_o$ is also held high (via the resistor $R_5$, as the switch $Q_1$ will be off). Thus, the output node o is held high (via diode $D_1$). Moreover, the capacitor $C_2$ is charged via resistor $R_3$, which closes the switch $Q_2$ (also a BJT). Thus, the positive pulse output $p_o$ is held low (but current cannot flow from the negative pulse output node $n_o$ to ground through switch $Q_2$ due to the diode $D_2$).

When a sudden negative pulse occurs (in the positive steady state), the positive node $i_1$ switches low and the negative node $i_2$ switches high. The negative pulse output $n_o$ therefore switches low. The positive pulse output $p_o$ is also held low, as the stored charge of the capacitor C2 keeps the switch Q2 open. Thus, the output node o is pulled low (as there is no high voltage provided thereto).

Thus, the output node o indicates whether a pulse is detected (low) or not (high).

Figure 7:
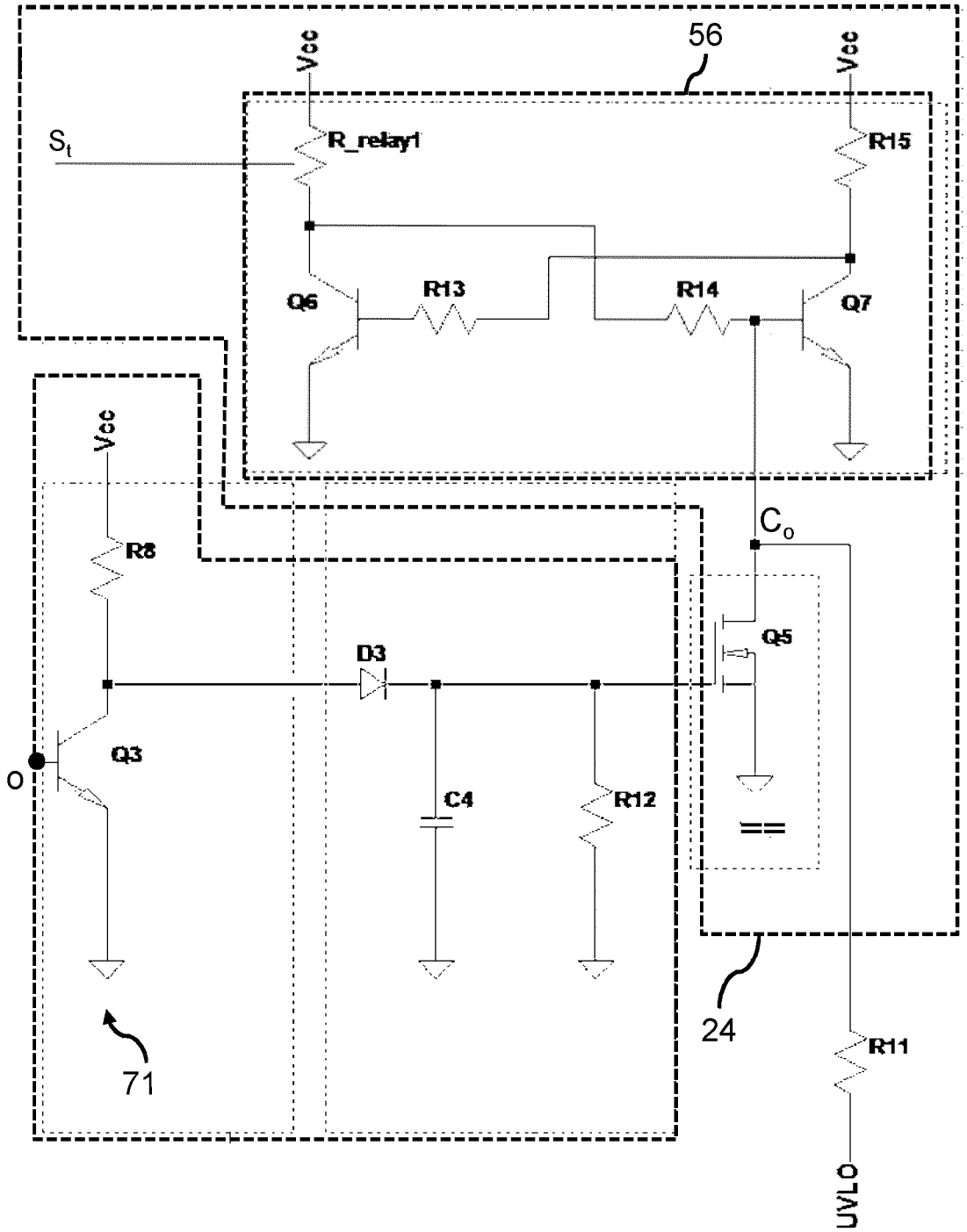
FIG. 7 is a circuit diagram illustrating part of a monitoring system and a type determination unit according to an embodiment.

FIG. 7 illustrates some further components for a monitoring system 23 and a type determination system 24 according to an embodiment.

An inverter 71 inverts the voltage at the output node o. A low pass filter D3, C4, R12 is used to filter out false pulses. The voltage across the capacitor C4 is representative of the average detection rate of pulses, effectively acting as a smoothing capacitor to average the rate of the pulses. A comparator Q5, here a transistor, activates (i.e. conducts current) if a voltage across the capacitor C4 reaches a threshold level, thereby effectively comparing the average detection rate to a reference detection rate. This brings an output $C_o$ of the comparator, and the type indicating signal $S_t$, to a ground voltage level if the comparator is activated to conduct current. Thus, a ground voltage at the output $C_o$ of the comparator indicates that a pulse or pulses have been detected in the monitored voltage level, and therefore that the power source is of a type comprising a certain igniter. Failure of the output $C_o$ to be pulled to ground indicates that no pulses have been detected, and that the power source can therefore be assumed to be of a second type (e.g. not comprising an igniter or the certain igniter associated with the reference detection rate).

A latch 56 latches the output $C_o$ of the comparator, and thereby the type indicating signal $S_t$ if the output $C_o$ switches to a ground voltage (e.g. to indicate that the power source is of the first type and thereby comprises an igniter).

The latch 56 is formed from a conventional flip-flop circuit, formed of a pair of transistors Q6, Q7 and appropriate connections (via resistors R13, R14, R15, R_relay1) between each other and a high voltage level. A collector (or drain) of each transistor Q6, Q7 is connected to a high voltage level Vcc via a respective resistor R_relay1, R15. An emitter (or source) of each transistor Q6, Q7 is connected to a ground voltage. The base (or gate) of a first transistor Q6 is connected to the collector or drain of a second transistor Q7 via resistor R13. The base (or gate) of the second transistor Q7 is connected to the collector or drain of the first transistor Q6 via resistor R14. The output Co of the comparator is connected to the base (or gate) of the second transistor. A voltage level at the collector or drain of the first transistor Q6 acts as the type indicating signal $S_t$, and is latched when the output of the comparator $C_o$ is pulled to ground.

In embodiments, the latch is initially activated at a power-up of the power source type determination unit by a reset signal UVLO that resets the type indicating signal $S_t$. Thus detection occurs only once at each turn-on or during operation. Once an igniter or a pulse(s) has been detected the type indicating signal remains low until the next power cycle.

Of course, it will be appreciated that the herein provided circuit diagram(s) illustrate only one possible implementation, and other implementations may include digital circuits, microprocessors, operational amplifiers and so on.

Figure 8:
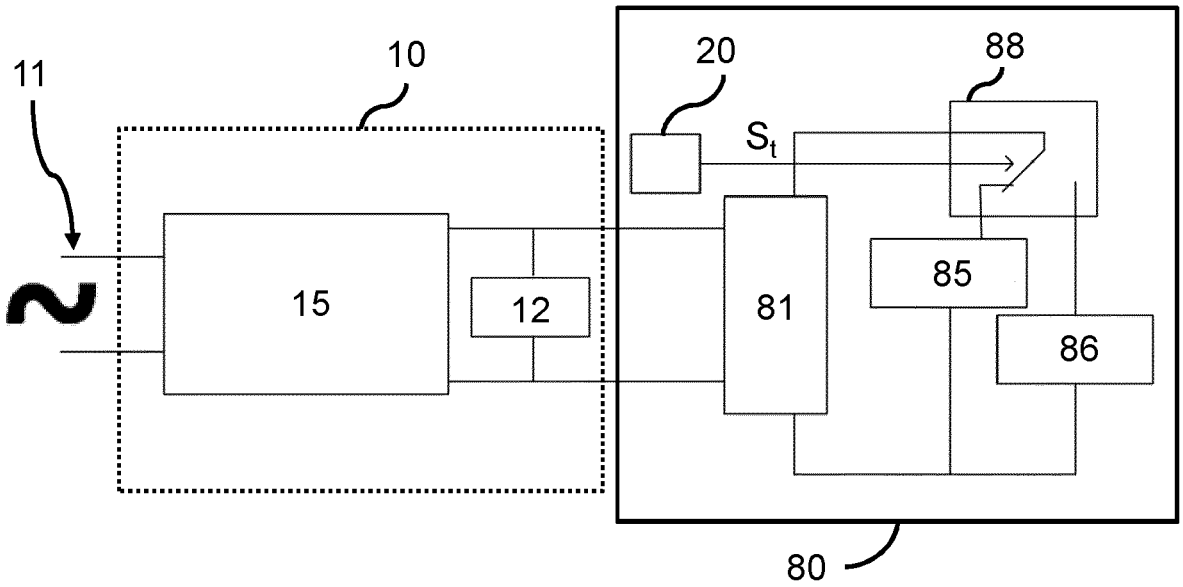
FIG. 8 illustrates a power source and an LED lighting unit according to an embodiment.

FIG. 8 illustrates a further embodiment of the invention, wherein the power source type determiner has been integrated into a LED lighting unit 80. The LED lighting unit 80 is connected to, and adapted to draw power from, a power source 10 (the type of which is not initially known).

The illustrated power source 10 comprises an igniter 12 and ballast circuitry 15 (e.g. comprising an EM ballast, not shown). However, the power source need not comprise such an igniter and/or ballast (depending upon the type of the power source).

The illustrated LED lighting unit 80 comprises a power source type determiner 20, such as those previously described, and a driver 81. The LED lighting unit 80 further comprises an LED arrangement 85, 86 formed of at least one LED.

In embodiments, (a portion of) the LED arrangement 85, 86 may act as the load for the power source type determiner. Thus, a control arrangement (e.g. integrated into the driver 81) of the power source type determiner may control a power/voltage drawn by the LED arrangement. The control arrangement may thereby also be integrated into the driver 81.

In a preferred embodiment, the LED arrangement comprises a first LED array 85 and a second LED array 86, each LED array being formed of at least one LED. The LED lighting unit 80 may further comprise a switching arrangement, configured to control which of the first and second LED arrays are able to draw power. In particular, the switching arrangement may be able to control or define a forward voltage of the LED arrangement. For example, the first LED array 85 is 180V to 220V, and the second LED array 86 is 100V to 150V.

The power source type determiner 20 may be further configured to control an operation of the switching arrangement based on the determined type of the power source 10. In particular, the power source type determiner 20 may be able to define which of the first and second LED arrays are able to draw power from the power source and thereby to define a forward voltage of the at least one LEDs. Alternatively, the two LED arrays 85 and 86 can be set in series connection to provide a high forward voltage in order to attempt to trigger the igniter.

It should be noted that the switching arrangement need not be just a selector of two different LED arrays (i.e. switching between the two) but is considered to be a switching arrangement that changes a configuration of the LEDs. This can be achieved be selectively bypassing one of more of the first and second LED arrays.

In particular, in response to determining that the power source is of a first type (i.e. a ballast input), the power source type determiner may cause the switching arrangement to configure the LEDs to have a first forward voltage, and in response to determining that the power source is of a second type (i.e. a mains input), the power source type determiner may cause the switching arrangement to configure the LEDs to have a second, higher forward voltage.

Such an embodiment helps improve the power factor of the LED lighting unit by adapted the LED lighting unit to a specific type of power source. Automatically controlling a configuration of the LED arrangement enables a plug-and-play replacement LED lighting unit (for replacing an existing HID lamp) to be provided.

Figure 9:
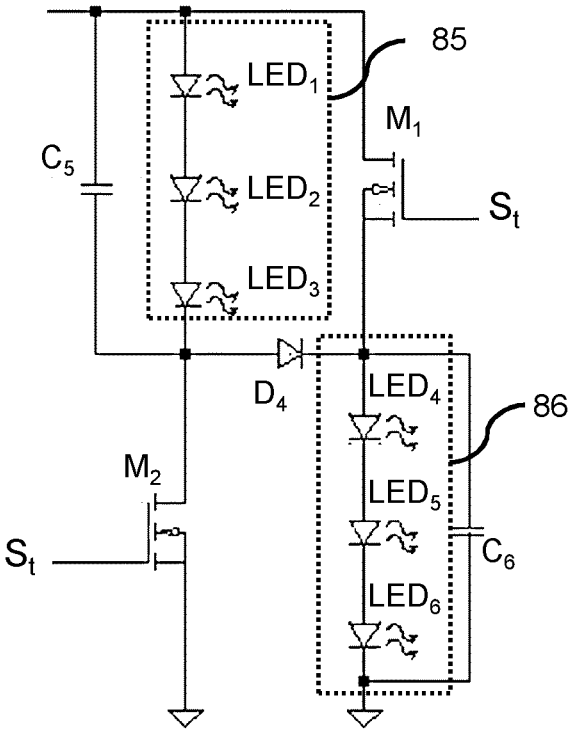
FIGS. 9 to 12 each illustrate a circuit diagram depicting an LED arrangement and switching arrangement for an LED lighting unit according to different embodiments.

FIG. 9 illustrates a configuration of the first LED array 85, the second LED array and the switching arrangement according to a first scenario.

The first LED array 85 and the second LED array 86 are connected in series via a diode $D_4$. Two electrolytic capacitors $C_5$, $C_6$ are connected in parallel with the first 85 and second 86 LED arrays respectively for filtering a ripple current for the LEDs. A first switch $M_1$ is connected between an input of the first LED array and an input of the second LED array. A second switch $M_2$ is connected between an input of the second LED array and an output of the second LED array. Controlling both switches effectively enables control over whether the first and second LED arrays are in parallel or in series, thereby controlling a forward voltage of the overall LED arrangement. Each switch $M_1$, $M_2$ may comprise a MOSFET, a BJT, a silicon-controlled rectifier (SCR), a relay contact, a mechanical switch contact and so on.

The switches $M_1$ and $M_2$ are controlled by the power source type determiner using the type indicating signal $S_t$, so that the power source type determiner is able to place the LED arrays 85, 86 in parallel or in series (i.e. and thereby control a forward voltage of the overall LED arrangement). This can be used to trigger a ballast igniter in which any single array's forward voltage is not yet sufficient.

In particular, when it is determined that the power source is of a first type (i.e. a ballast and igniter contributes to the power drawn by the LED lighting unit), the LED arrays should be placed in parallel to reduce a forward voltage of the LED arrangement, for stopping the igniter as well as providing a desired lamp power. When it is determined that the power source is of a second type (i.e. and neither a ballast nor igniter contribute to the power drawn by the LED lighting unit), then the LED arrays could be placed in series, to increase a forward voltage of the overall LED arrangement for providing the same desired lamp power, with the aid of an extra converting circuit which is not described in the application but will be filed in a separate application.

Placing $C_5$, $C_6$ in parallel with a respective LED array (rather than a single capacitor in parallel to the overall LED arrangement) avoids creating an inrush for the LEDs when switching from a series to parallel configuration.

Figure 10:
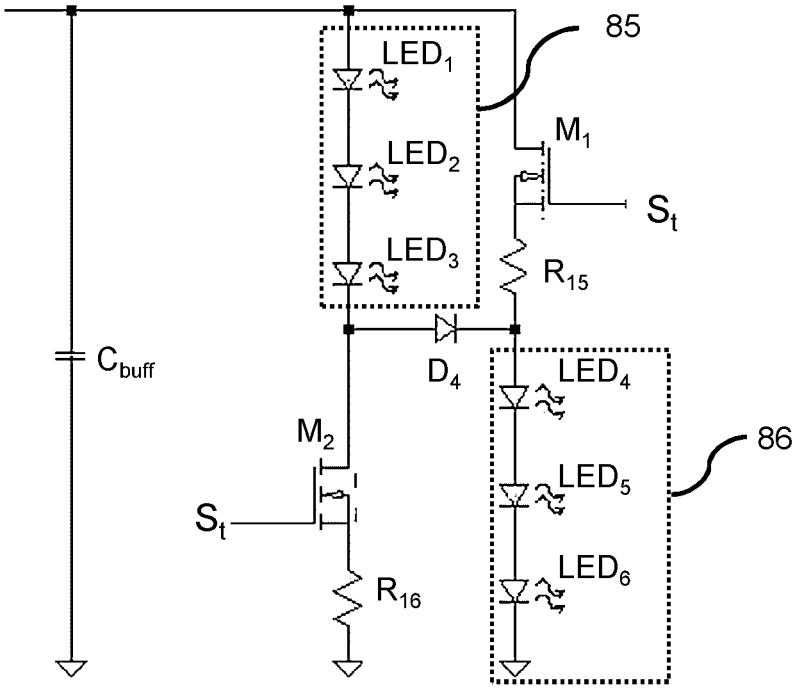

FIG. 10 illustrates a configuration of the first LED array 85, the second LED array 86 and the switching arrangement according to a second scenario.

The configuration according to the second scenario differs from the configuration for the first scenario in that the capacitor $C_5$, $C_6$ of the first scenario have been replaced by a single capacitor $C_{buf}$ (in parallel with the overall LED arrangement). To mitigate a potential inrush current when switching from a series to parallel configuration, resistors $R_{15}$,$R_{16}$ are introduced (one in series with each switch $M_1$, $M_2$). This limits the inrush current. Alternatively, a limiting current source can be built around the resistors.

Figure 11:
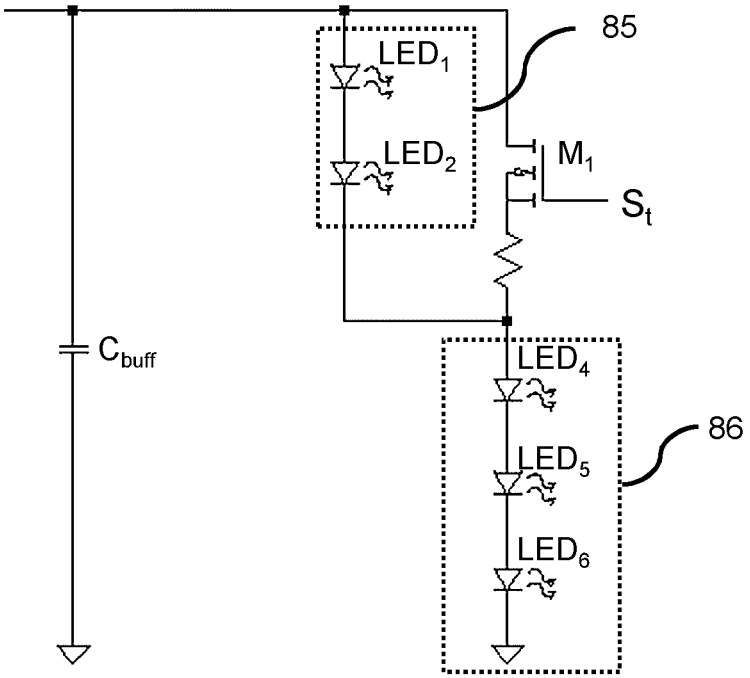

FIG. 11 illustrates a configuration of the first LED array 85, the second LED array 86 and the switching arrangement in parallel with the first array 85 according to a third scenario. In this scenario, the first LED array 85 has a first forward voltage (e.g. 40V) and the second LED array 86 has a second, higher forward voltage (e.g. 140V). Thus, the first LED array 85 can be bypassed in order to control a forward voltage of the overall LED arrangement.

Control of the bypassing is performed by a single switch $M_1$ controlled by the type indicating signal $S_t$ generated by the power source type determiner (not shown).

Figure 12:
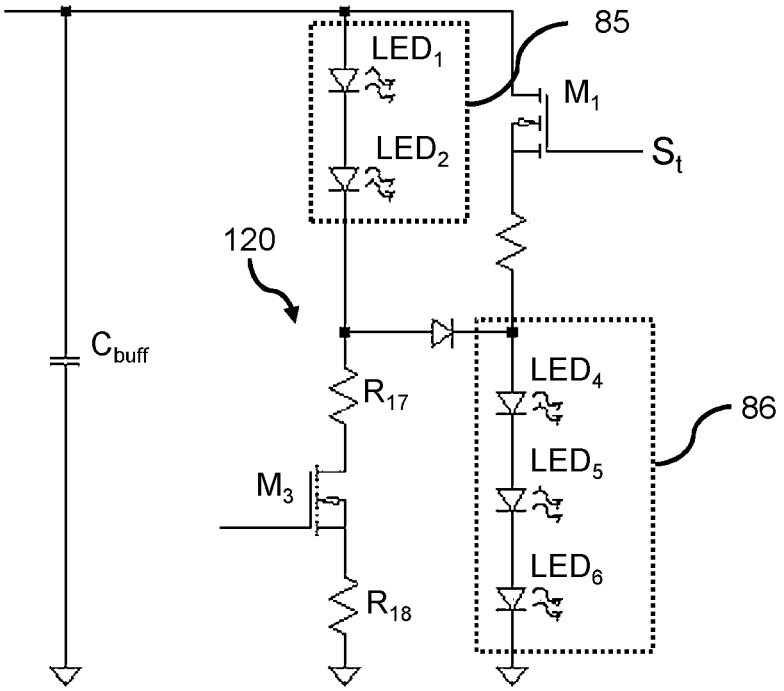

FIG. 12 illustrates a configuration of the first LED array 85, the second LED array and the switching arrangement according to a fourth scenario.

The configuration according to the fourth scenario differs from the configuration for the third scenario (of FIG. 11) by further comprising a current limiting circuit 120 in series with the first LED array (having a lower voltage). The current limiting circuit comprises a pair of resistors R17, R18 and a switch $M_3$ in series. The switch is also controlled by the type indicating signal $S_t$ so that when the first switch $M_1$ is active (to bypass the first LED array) the switch $M_3$ is also active to limit a current passing through the first LED array, by effectively increasing a voltage drop between an input of the first LED array and ground.

The current limiting circuit avoids a situation in which LEDs are bypassed (i.e. and not emitting light, as would happen in the third scenario), whilst still enabling control over the forward voltage of the LED arrangement (as the current limiting circuit will increase an effective forward voltage for the first LED array).

In particular, the current limiting circuit may be designed so that the voltage across the LED array and current limiting circuit is similar or identical to a forward voltage of the second LED array 86. This allows for improved control over the forward voltage of the overall LED arrangement.

Figure 13:
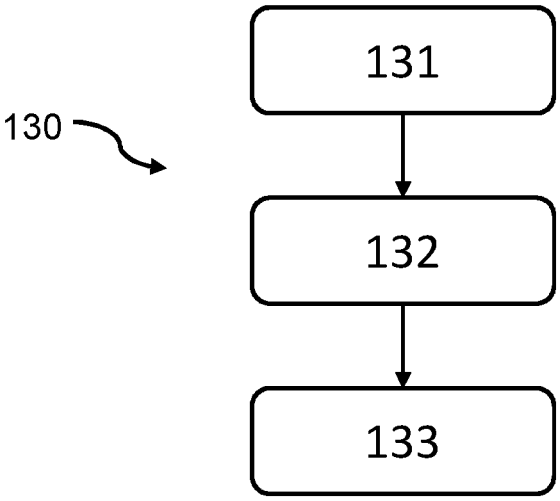
FIG. 13 is a flowchart illustrating a method according to an embodiment of the invention.

FIG. 13 is a flowchart illustrating a method 130, of determining a type of a power source, for an LED lighting unit and originally designed for a high intensity discharge lamp, according to an embodiment of the invention.

The method 130 comprise a step 131 of setting a characteristic of a load to a first level able to draw power from the power source. The method 130 further comprises a step 132 of, after setting the characteristic to the first level, obtaining a first value of an electrical parameter of the load or the power source. The method 130 further comprises a step 133 of processing the first value to generate a type indicating signal indicating the type of the power source.

In one embodiment, the step 131 of setting comprises setting a forward voltage of the load as the first level to no less than a first threshold value for attempting to trigger a igniter of the power source to output a pulse; the step 132 of obtaining a first value of an electrical parameter comprises obtaining a value indicating whether a pulse has occurred; and the step 133 of processing the first value comprises generating the type indicating signal indicating whether or not a pulse has occurred and thereby whether or not the power source is of a type comprising the igniter, In another embodiment, the step 131 of setting comprises switching a power level of a power drawn by a load between a second level and the first, higher level; the step 132 of obtaining a first value comprises obtaining a second value before the switch and obtaining the first value after the switch; and the step 133 of processing the first value comprises processing the difference between first and second values to thereby generate a type indicating signal indicating the type of the power source.

The skilled person would be readily capable of developing a processing system for carrying out a previously described method. Thus, each step of the flow chart may represent a different action performed by a processing system, and may be performed by a respective module of the processing system.

The above description shows detecting the type of the power source according to pulse of the power source. The pulse from the igniter, if too many/frequently happen, is not good for the ballast. Thus it is needed to stop the pulse, after triggering it by the large forward voltage as mentioned above. The basic idea of stopping the pulse is lowering the forward voltage/output voltage such that the igniter would reset and stop generating the pulse. The below embodiment shows an innovation according to this basic idea.

Figure 14:
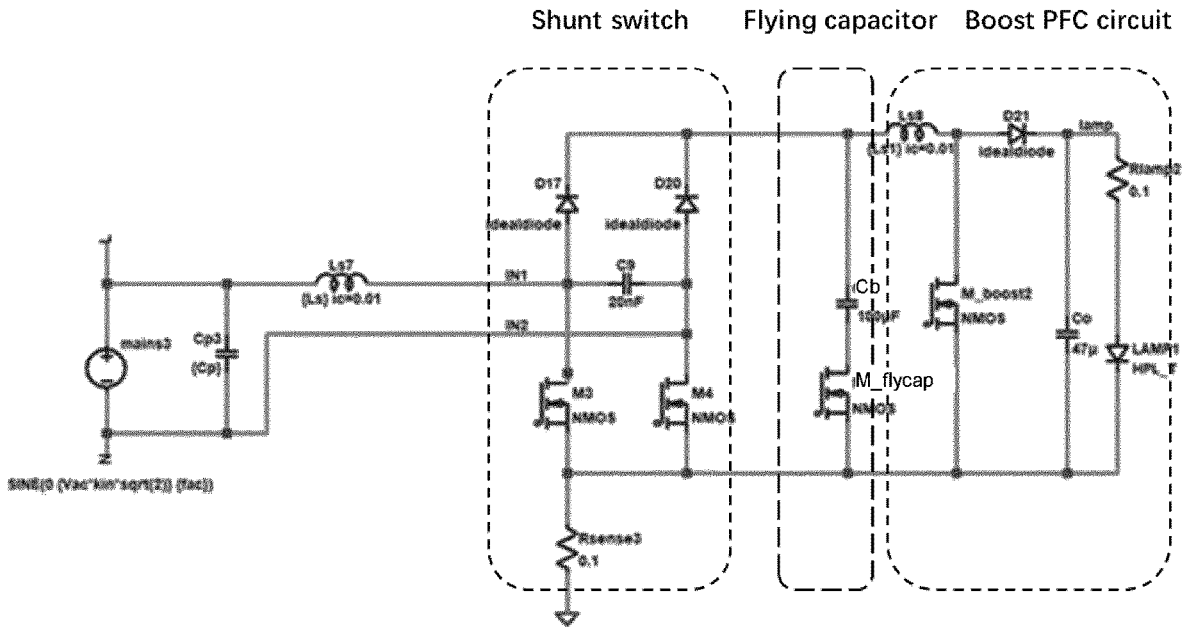
FIG. 14 is a topology that can work in both type A and type B fixture.

FIG. 14 showed a driver architecture to be compatible with both type A and type B system. The AB detection circuit will detect and judge whether it is type A system or type B system. If type A system, it will switch to type A operation mode in which the shunt switch operates in partially pass through mode and the boost PFC also operates. If type B system, it will switch to type B system in which the shunt switch is fully pass through (full rectifier) and the boost PFC operates. As shown in FIG. 14, at type A operation mode, M3 & M4 operates as synchronous shunt switch, M_flycap keeps on. M_boost 2 operates as boost circuit. At type B operation, M1 & M2 operate as synchronous rectified bridge or turn off and operates as rectifier; M_boost2 operates as boost PFC circuit. The boost PFC circuit can be replaced by any PFC circuit, like buck or buck-boost.

The PFC circuit inherently has low response control loop/response speed, for example the duty cycle is relatively slowly-controlled, such that the current can follow the input voltage and PFC can be achieved.

For determining the type of the power source, the lighting unit works in type B first and the boost circuit will increase the bus voltage to 300V to trigger the igniter. After that, the above-mentioned method to detect the pulse from the igniter so as to determine the type of the power source will be implemented. If it is determined as type A, however, it is needed to decrease the bus voltage to around 130V to reset the igniter. Since the second stage is PFC stage which has slow response to voltage drop on bus, if the bus voltage drops too quickly, the PFC stage would not response in time and dip light occurs.

Figure 15:
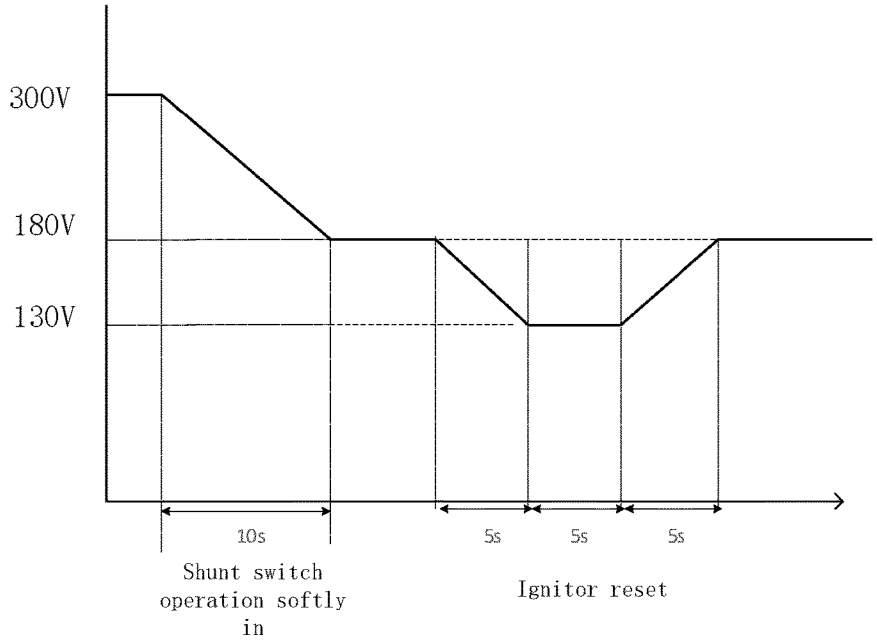
FIG. 15 shows slowly decreasing the bus voltage to reset the igniter according to a further embodiment of the invention.

To avoid dip light, the invention needs stable bus voltage. And for igniter compatibility, we need low enough bus voltage to reset ignitor. Thus the idea is to control the bus voltage very slowly changed, the voltage change speed should be slower/comparable with respect to the response time of second stage boost PFC control. And the lowest voltage should be low enough to make ignitor reset like 130V below. E.g. the voltage firstly slowly decreasing from 300V around to 180V in 10 s when shunt switch operation switched in, and further decrease from 180V to 130V in 5 s and keep 130V for 5 s for ignitor reset. And return back to 180V in 5 s to avoid dip light. This is shown in FIG. 15.

In this embodiment, the voltage 130V is fixed according to in-lab test and is expected to reset all/most of the igniter. In another embodiment, the voltage to which the bus voltage is decreased can be dynamically determined: as the voltage decreases, a circuit is detecting the occurrence of the pulse, and if there is no pulse occurred anymore, the voltage decreasing can stop.

The above embodiment uses the detection of pulse to determine the type of the power source. Below will describe another innovation. A second innovation of the basic idea is to change an amount of power that the load attempts to draw and to then monitor how the power source reacts. Some types of power source, such as power sources not comprising a ballast, may not react significantly to the change in power drawn, but a type of power source comprising a ballast may do. Even more, some group of ballasts may react less significantly to the change than the other group of ballasts. Thus, changing the power attempted to be drawn by a load can be used to identify a type of the power source. More specifically, it is the slew rate of rising in the output voltage of the power source, given different load condition, is measured to determine the type of the power source.

The topology of the converter is still a SMPS, like a boost converter, between the LED and the power source. Between the converter and the power source there may be a rectifier, which could be normal four-diodes rectifier or the above-mentioned synchronous rectifier formed by two diodes and two active switches.

When power up, the converter operates at low PF boost to converter the input power to the LED current. The converter changes the LED current, and variation of the output voltage of the power source is detected to determine its type. More specifically, if the variation rate is significantly different given the different LED current, the power source can be determined as a ballast for gas discharge lamp. Otherwise the power source can be determined as AC mains.

Figure 16:
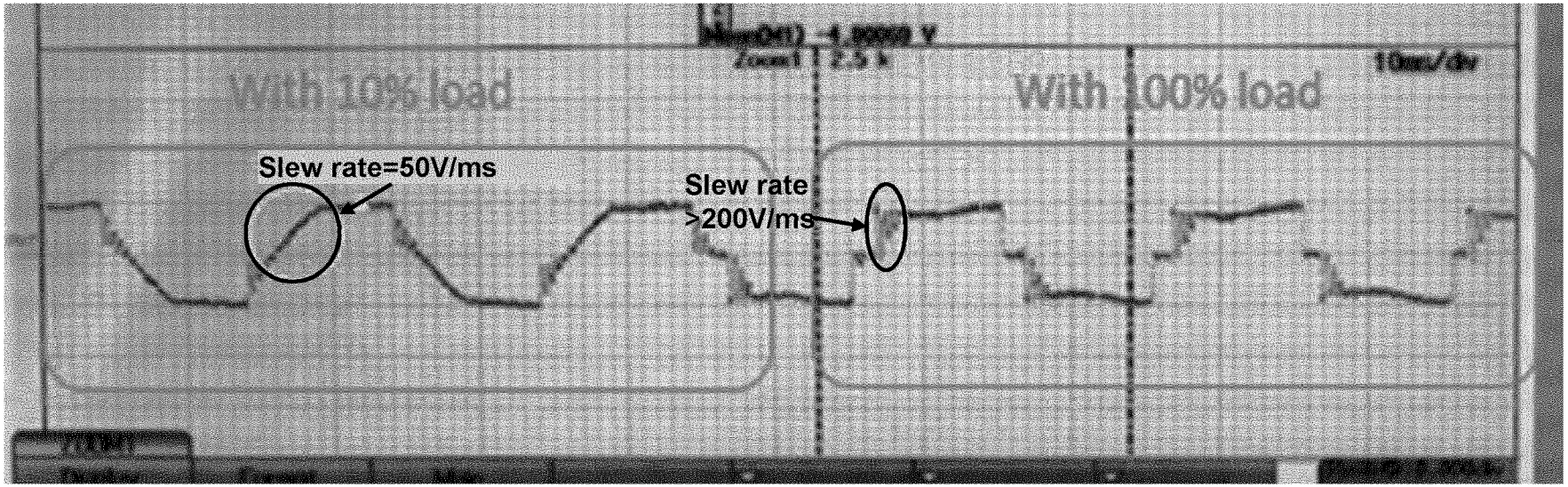
FIG. 16 shows another innovation to determine the type of the power source according to another embodiment of the invention.

In a specific example, detecting the slew rate of a rising output voltage of the power source at the same phase (like the rising phase), at 10% to 100% load current, if the slew rate changes with load current (e.g. >4 or 5 times difference) as shown in FIG. 16, it is type A system. It can be seen that at 10% load current, the slew rate of the output voltage is smooth, for example 50V/ms; while at 100% load current, the slow rate is very high, for example >200V/ms (even with some high frequency oscillation). Otherwise it is type B system since the AC mains voltage is not influenced as much by the load condition.

Another embodiment of the second innovation will be described below. The basic idea is analyzing the difference of the waveform input voltage before and after a certain electrical component is switched in the power loop. more specifically, the certain electrical component is a capacitor Cb in parallel across the output of the rectifier, as shown in FIG. 14. Here we propose an updated A/B detection method to accurately detecting type A/B system. The input driver voltage waveform will be sensed and stored before Cb switched in in order to get the voltage information of power source. And after switching in Cb, the power source's output voltage will be sensed and stored again. Compare the voltage waveforms before Cb switched in and after Cb switched in, if it is same waveform it is type B system (AC mains) and if it has large difference it is type A system (ballast). The following parameter (not limited) before and after Cb switched in can be used/compared to identify the difference.

Figure 17:
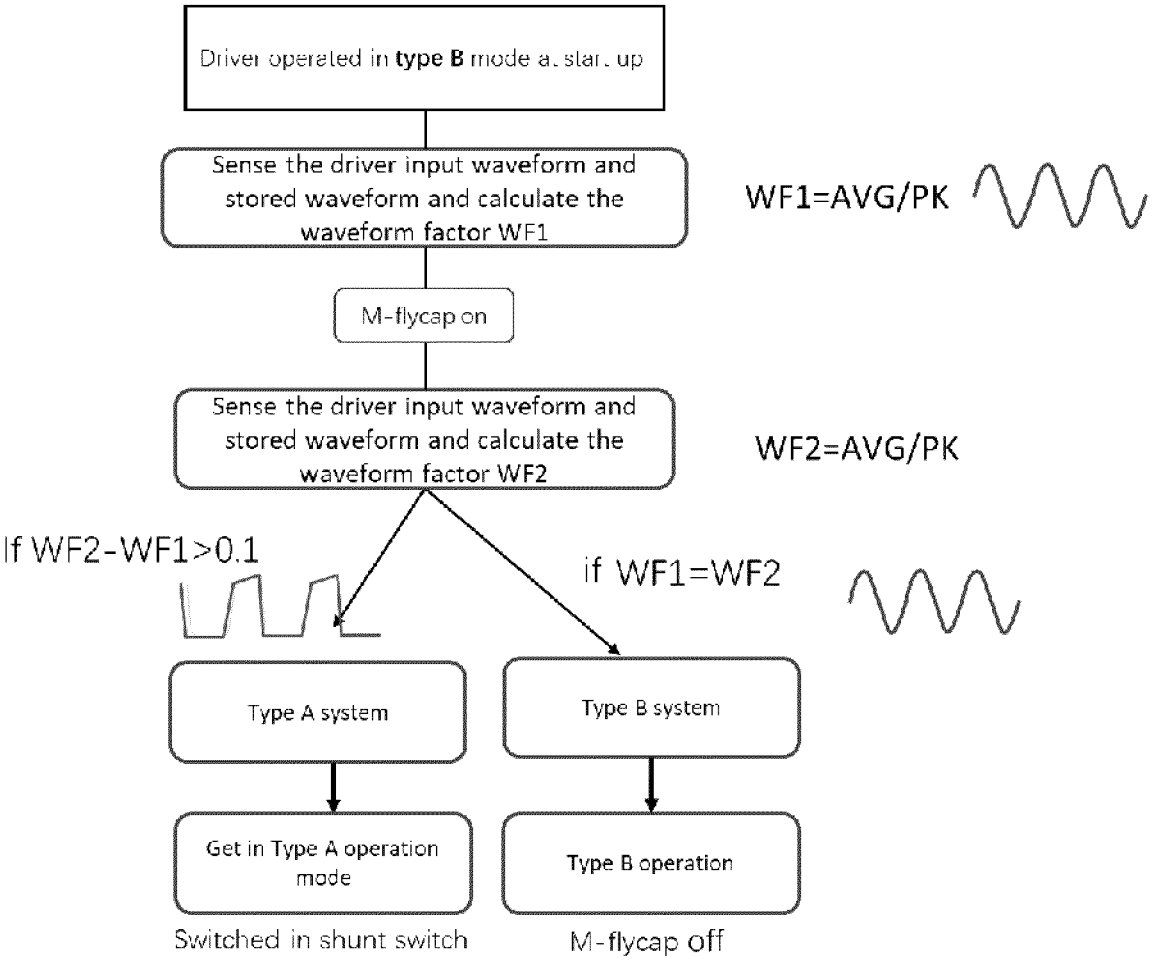

A ratio of average value of power source's output voltage divided by peak value thereof. This ratio is named as WF in FIG. 17, wherein WF1 is that before the capacitor switched in and WF2 is that after. FIG. 17 shows a flowchart of this implementation. If WF1 substantially equals to WF2, the power source is AC mains; if WF2 is substantially different from WF2, for example WF2−WF1>0.1, the power source is determined as ballast.

Frequency component obtained by using FFT analysis for example. If the components are substantially same, the power source is AC mains; otherwise the power source is determined as ballast. For example, if $1^{st}$, $3^{rd}$ or $5^{th}$ order harmonic is different by at least 10%, the power source is determined as ballast.

As discussed above, embodiments make use of a processing system. The processing system can be implemented in numerous ways, with software and/or hardware, to perform the various functions required. A processor is one example of a processing system which employs one or more microprocessors that may be programmed using software (e.g., microcode) to perform the required functions. A processing system may however be implemented with or without employing a processor, and also may be implemented as a combination of dedicated hardware to perform some functions and a processor (e.g., one or more programmed microprocessors and associated circuitry) to perform other functions.

Examples of processing system components that may be employed in various embodiments of the present disclosure include, but are not limited to, conventional microprocessors, application specific integrated circuits (ASICs), and field-programmable gate arrays (FPGAs). In various implementations, a processor or processing system may be associated with one or more storage media such as volatile and non-volatile computer memory such as RAM, PROM, EPROM, and EEPROM. The storage media may be encoded with one or more programs that, when executed on one or more processors and/or processing systems, perform the required functions. Various storage media may be fixed within a processor or processing system or may be transportable, such that the one or more programs stored thereon can be loaded into a processor or processing system.

It will be understood that disclosed methods are preferably computer-implemented methods. As such, there is also proposed the concept of computer program comprising code means for implementing any described method when said program is run on a computer. Thus, different portions, lines or blocks of code of a computer program according to an embodiment may be executed by a processor/computer to perform any herein described method.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. If a computer program is discussed above, it may be stored/distributed on a suitable medium, such as an optical storage medium or a solid-state medium supplied together with or as part of other hardware, but may also be distributed in other forms, such as via the Internet or other wired or wireless telecommunication systems. If the term "adapted to" is used in the claims or description, it is noted the term "adapted to" is intended to be equivalent to the term "configured to". Any reference signs in the claims should not be construed as limiting the scope.

The invention claimed is:

1. A power source type determiner for identifying a type of a power source for powering a LED lighting unit, wherein one possible type of a power source comprises a ballast originally designed for a discharge lamp, the power source type determiner comprising:

a control arrangement adapted to set a forward voltage level across the LED lighting unit to at least a first forward voltage and a second forward voltage, lower than the first forward voltage;

a monitoring system adapted to monitor an electrical parameter of the load or of the power source; and a type determination unit adapted to:

receive, from the monitoring system, a first value of the electrical parameter, wherein the first value is obtained during a response of the power source to the control arrangement setting the forward voltage of the LED lighting unit to the first forward voltage; and process the first value to generate a type indicating signal indicating the type of the power source;

wherein the electrical parameter comprises the occurrence of a pulse in a voltage level provided by the power source.

2. The power source type determiner of claim 1, wherein:

the control arrangement comprises a switch for switching a forward voltage of the LED lighting unit between the first forward voltage and the second forward voltage.

3. The power source type determiner of claim 2, wherein the pulse has a length less than a predetermined length and a magnitude of more than a predetermined magnitude.

4. The power source type determiner of claim 3, wherein:

a first type of power source comprises a ballast with an igniter, and a second type of power source is without an igniter;

the electrical parameter comprises the occurrence of a pulse from the igniter of the power source; and the type determination unit is adapted to distinguish between the first type of power source and the second type of power source based on whether or not the first value indicates the occurrence of the pulse.

5. The power source type determiner of claim 3, wherein the first forward voltage is no less than a first threshold voltage value that would trigger an igniter of a power source to output said pulse, and wherein the ballast comprises a high intensity discharge (HID) lamp ballast, the second type of power source comprises AC mains.

6. The power source type determiner of claim 3, wherein:

a first type of power source comprises a SON-type ballast with a first igniter and a second type of power source comprises an MV-type ballast with a second, different igniter or without an igniter;

the electrical parameter comprises the occurrence of a pulse from the first igniter of a SON type ballast; and the type determination unit is adapted to generate the type indicating signal indicating the type of the power source based on whether or not the occurrence of the pulse is detected.

7. The power source type determiner of claim 6, wherein the first forward voltage is no less than a second threshold voltage value that would trigger the first igniter of the SON-type ballast to output said pulse, and optionally lower than a third threshold voltage value that would trigger the second, different igniter of the MV ballast, and the SON-type ballast and the MV-type ballast are high intensity discharge lamp ballast.

8. The power source type determiner of claim 3, wherein the monitoring system comprises a positive pulse detector comprising:

a positive voltage detector adapted to generate an output indicating whether a positive voltage is detected in a voltage level provided by the power source;

a negative voltage holder adapted to:

generate an output indicating whether a negative voltage is detected in a voltage level provided by the power source;

hold the output for at least a holding time period after the negative voltage is removed, and a positive pulse output unit that generates an output indicating whether the output of the positive pulse detector indicates that a positive voltage is detected and the held output of the negative voltage holder indicates that a negative voltage has been detected during the holding time period preceding detection of the positive voltage by the negative voltage detector.

9. The power source type determiner of claim 3, wherein the monitoring system comprises a negative pulse detector comprising:

a negative voltage detector adapted to generate an output indicating whether a negative voltage is detected in a voltage level provided by the power source;

a positive voltage holder adapted to:

generate an output indicating whether a positive voltage is detected in a voltage level provided by the power source;

hold the output for at least a holding time period after the positive voltage is removed, and a negative pulse output unit that generates an output indicating whether the output of the negative pulse detector indicates that a negative voltage is detected and the held output of the positive voltage holder indicates that a positive voltage has been detected during the holding time period preceding detection of the negative voltage by the negative voltage detector.

10. The power source type determiner of claim 1, wherein:

the level of the characteristic of the load is the power level drawn by the load; and the type determination unit is adapted to:

receive, from the monitoring system, a second value of the electrical parameter, when the control arrangement sets the power drawn by the load to the second level;

receive, from the monitoring system, the first value of the electrical parameter, when the control arrangement sets the power level drawn by the load to the first level;

process the first value of the electrical value by:

determining a change in the electrical parameter using the first value and the second value; and processing the change to generate a type indicating signal indicating the type of the power source for powering the LED lighting unit.

11. The power source type determiner of claim 10, wherein the type determination unit is adapted to generate a type indicating signal indicating the type of the power source is:

a mains supply when the change is less than a first threshold, and a type of power source comprising a ballast when the change is no less than the first threshold; and/or the type determination unit is adapted to generate a type indicating signal indicating the type of the power source is:

a type of power source comprising a first type of ballast when the change is less than a second threshold, and a type of power source comprising a second type of ballast when the change is no less than the second threshold.

12. The power source type determiner of claim 10, wherein the electrical parameter comprises a magnitude characteristic or a time characteristic of a voltage level provided by the power source;

optionally wherein said magnitude characteristic comprises any one of root mean square value, peak to peak value, or average value of the voltage level, or optionally wherein said time characteristic comprises a frequency or a phase of the voltage level.

13. The power source type determiner of claim 10, wherein the second level is zero so that the load does not attempt to draw power, and the first level is larger than zero so that the load attempts to draw at least some power.

14. A LED lighting unit comprising:

an LED arrangement formed of one or more LEDs; and the power source type determiner of claim 1, wherein the load of the power source type determiner comprises the LED arrangement.

15. The LED lighting unit according to claim 14, further comprising:

a first converter adapted to connect to the power source and convert the power from the power source to a first power;

a second converter to convert the first power to a second power to the LED arrangement;

the first converter is adapted to be in a full pass-through operation and the second converter is adapted to set the forward voltage as the first forward voltage to facilitate the determination of the power source determiner;

wherein, the first converter is adapted to be in a partially pass-through operation when the power source has been determined as the ballast originally designed for a discharge lamp in the determination;

characterized in that, the first converter is adapted to decrease the first power and the forward voltage across the LED lighting unit to the second forward voltage to stop the ballast from generating the pulse, wherein the first converter is adapted to decrease the first power at a speed to which the second converter is responsive.

16. The LED lighting unit according to claim 15, wherein the first converter is a shunt switch circuit to short circuit the LED lighting unit, and the second converter is a switch mode converter with PFC function and a PFC response speed, the first converter is adapted to be in a full pass-through operation by not short circuit the LED lighting unit at all, and the second converters is adapted to implement PFC function, when the power source has been determined as AC mains.

* * * * *